United States Patent [19]

Kummel et al.

[11] 4,188,915

[45] Feb. 19, 1980

[54] WATER-COOLED, HIGH-TEMPERATURE GASIFIER

[75] Inventors: Joachim Kummel, Kaarst; Heinz Dressen, Willich; Wilhelm Danguillier; Paul Gernhardt, both of Bochum; Wolfgang Grams, Herne; Siegfried Pohl, Bochum, all of Fed. Rep. of Germany

[73] Assignees: Dr. C. Otto & Comp. G.m.b.H., Bochum; Saarbergwerke A.G., Saarbrucken, both of Fed. Rep. of Germany

[21] Appl. No.: 886,386

[22] Filed: Mar. 14, 1978

Related U.S. Application Data

[63] Continuation-in-part of Ser. No. 746,400, Dec. 1, 1976, Pat. No. 4,098,324.

[30] Foreign Application Priority Data

Dec. 5, 1975 [DE] Fed. Rep. of Germany ..... 2554666

[51] Int. Cl.[2] ..... F22B 37/00

[52] U.S. Cl. ..... 122/6 A; 122/235 A; 165/133; 48/67

[58] Field of Search ..... 122/6 A, 235 P; 165/133; 48/67

[56] References Cited

U.S. PATENT DOCUMENTS

| | | | |
|---|---|---|---|
| 2,013,658 | 9/1935 | Kerr | 122/6 A |
| 2,181,950 | 12/1939 | Murray, Jr. | 122/6 A |
| 2,248,891 | 7/1941 | Murray | 122/6 A X |

*Primary Examiner*—Albert W. Davis, Jr.
*Attorney, Agent, or Firm*—Thomas H. Murray

[57] ABSTRACT

A system is provided for cooling high-temperature, high-pressure gasifiers having cooling tubes which extend vertically through the walls of the gasifier and are connected in a closed cooling water circulation system.

In accordance with the invention, the cooling tubes are coated on the inside of the gasifier with a plasma or flame sprayed ceramic coating, preferably consisting of alumina, and are embedded in a ramming compound such as tamped clay.

7 Claims, 3 Drawing Figures

WATER-COOLED, HIGH-TEMPERATURE GASIFIER

BACKGROUND OF THE INVENTION

This is a continuation-in-part of our copending application Ser. No. 746,400, filed Dec. 1, 1976 now U.S. Pat. No. 4,098,324 granted July 4, 1978.

The present invention relates to a cooling system for a high-temperature gasifier such as the slag bath generator shown in U.S. Pat. No. 4,013,427 and having a cooling system such as that disclosed therein and in the above-mentioned copending application.

A high-temperature gasifier can reach operating temperatures of between 1500° C. and 2200° C. Slag bath generators are particularly suitable as high-temperature gasifiers and are characterized by a simple mode of slag discharge. That is, the slag collects as the generator bottom in the molten state and the discharges through an overflow weir. The fluid level in the generator can be established as desired by means of the overflow weir.

Certain of the older gasifiers are operated at atmospheric pressure or with a slight positive pressure of about 0.2 bar. More recent generators, on the other hand, utilize a pressure of 20 bar or more in the gasification chamber. The output for a given gasifier surface cross section is multiplied by the pressure so that only such so-called high-pressure gasifiers are being used if large outputs are required.

Particularly intensive cooling is necessary to meet the high gasifier temperature and high gas pressure. The gasifier is, therefore, provided with walls having tubes extending therethrough and through which cooling water flows in a closed circuit. These tubes are covered with a coating of refractory ramming compound such as tamped clay so that they are not directly exposed to the high operating temperatures. Since the tubes are smooth, the ramming compound will not readily adhere to the tubes. In prior art gasifiers, pins are welded to the tubes, for example in two rows on each tube, extending in the longitudinal direction thereof. so that oppositely-disposed rows of pins of two adjacent tubes are inclined at an angle toward each other. This provides sufficient retention for the ramming compound on the tubes, at least when the gasifier is started up.

During the starting-up procedure, the ramming compound surface nearest the interior of the gasifier reaches a temperature of between 600° C. and 800° C., depending upon the thickness of the ramming compound. The melting point of the slag is above this temperature, usually between 900° C. and 1500° C. The slag deposited on the ramming compound, therefore, solidifies and reinforces the thermal insulation so that no further slag solidifies after a specific slag coating thickness has been reached. Any slag which is then precipitated within the gasifier remains liquid and flows into the slag bath at the bottom of the generator where it flows out through the aforesaid weir.

The slag continues to adhere to the interior of the gasifier wall for as long as the latter is operated at a uniform operating temperature. If the temperature is reduced (i.e., when the gasifier is shut down), there is a risk that the slag coating will become partially detached due to contractions. The tubes of the cooling system will, therefore, be exposed at these places either because the slag coating adheres too strongly to the ramming compound or the ramming compound itself has been reduced due to slag diffusion through the slag coating.

Exposed or bare cooling tubes gives rise to extreme risks because of the high temperatures to which they are exposed with resultant danger of tube failure. It has been attempted to avoid or reduce these risks by using higher flow rates for the cooling water or by suitable temperatures of the cooling water but these expedients do not fully meet the problem.

SUMMARY OF THE INVENTION

The purpose of the present invention is to insure that slag will deposit on the cooling tubes to provide the desired thermal insulation even when the original tamped clay cover has been pulled off by contraction of the slag deposited on it or has been decomposed by diffusion of the slag.

In accordance with the invention, the walls of the cooling tubes are coated with a ceramic coating applied by plasma or flame-spraying in a manner to provide a rough surface, after which the usual tamped clay cover is applied. The ceramic coating preferably consists of alumina ($Al_2O_3$) with a thickness of from 0.2 to 3.0 millimeters. Such a coating inherently provides radiation protection and, if the original tamped clay cover has been lost, the solidifying slag adheres to the rough surface of the ceramic coating so that a layer of slag is always present and the cooling tubes are not exposed.

In accordance with a further feature of the invention, the retaining means for the tamped clay is arranged so as not to prevent its breaking up during initial operation of the generator. For this purpose, the retaining means is attached only indirectly to the cooling tubes. The retainer can be made of wire netting or expanded metal and is preferably fastened to the webs which extend between the tubes to form a gas-tight wall.

The invention will be more fully understood from the following detailed description, taken in connection with the accompanying drawings, in which.

Figure 1:
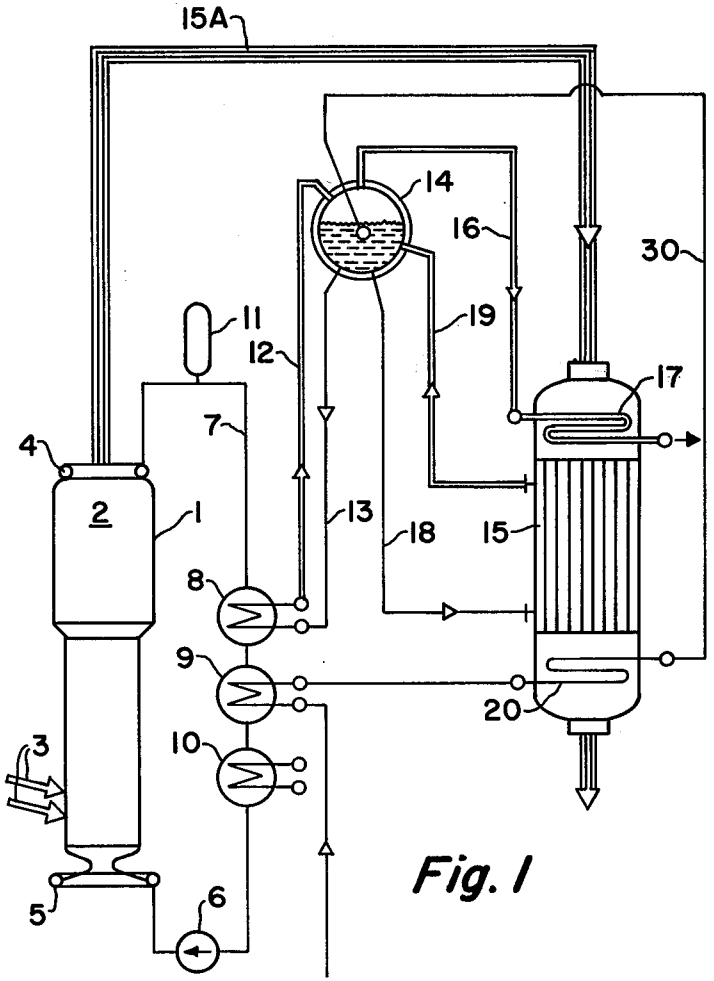
FIG. 1 is a schematic illustration of a slag bath generator cooling system in which the invention may be embodied.

The invention is shown for the purpose of illustration embodied in a generator cooling system of the type shown in the above-mentioned copending application Ser. No. 746,400, although its usefulness is, of course, not limited to this particular type of system. With reference to the drawings, and particularly to FIG. 1, the cooling walls of a slag bath generator are designated generally by the reference numeral 1. The generator is shown diagrammatically and may be of any suitable construction, but is preferably of the construction shown in U.S. Pat. No. 4,013,427. The cooling walls surround the gasification chamber 2 of the gasifier which is supplied with coal dust, oxygen and water vapor as indicated generally by the arrows, reference numeral 3. The particular fuel which is being gasified is immaterial. The kind of material gasified only affects the quantity of the gasification medium which is produced. The slag bath and the flame jet of the generator which is directed to the bath enable any desired temperature up to 2500° C. to be obtained.

Figure 3:
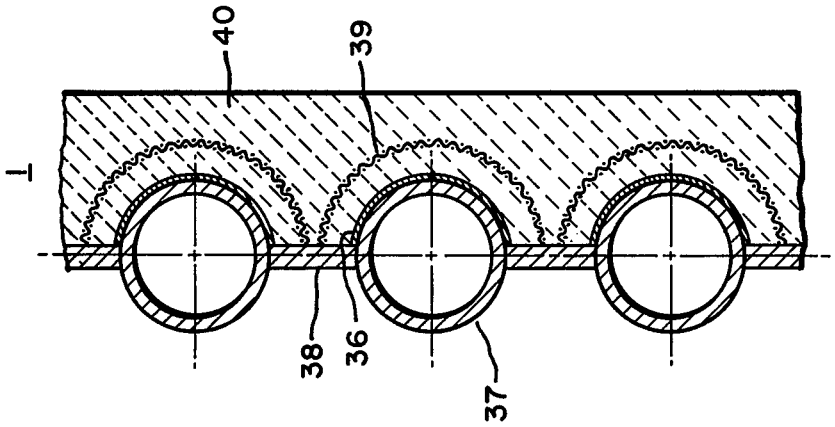
FIG. 3 is a transverse sectional view of the wall of FIG. 2.
Figure 2:
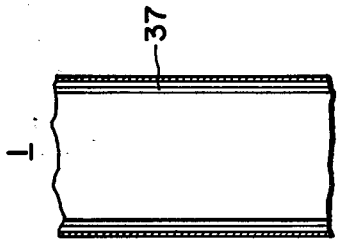
FIG. 2 is an enlarged fragmentary view of a portion of the wall of a slag bath generator embodying the invention.

The cooling walls 1 comprise a plurality of vertical or horizontal cooling tubes which impart the longitudinal sectional shape shown diagrammatically in FIG. 1 to the space surrounded by the cooling walls 1, the cooling tubes merging aat the top end into a ring main 4 and at the bottom end to a ring main 5. The cooling tubes 37 preferably extend vertically to form the wall 1 as shown in FIG. 2 and as disclosed in the above-mentioned patent. The cross section of the tube wall is shown in FIG. 3 and will hereinafter be explained in detail. A circulating pump 6 pumps sufficient cooling water into the bottom ring main 5 to insure that cooling water at a temperature of 200° C. flows from the main ring 5 at a velocity of 5 to 7 meters per second through the cooling tubes, which have a maximum internal diameter of 51 millimeters, into the top ring main 4. Assuming an operating temperature of 1700° C. to 2500° C. in the gasifier, the cooling water is heated through 25° C. while passing through the tubes with a cooling water pressure of 40 bar. The cooling water pressure and the velocity prevent boiling of the cooling water as explained above.

The heated cooling water from the top ring main 4 is supplied through a circulating line 7 to several heat exchangers 8, 9 and 10 which are connected in series. After leaving the last heat exchanger 10, the cooling water is again returned to the cooling tubes at a temperature of 200° C. A compensating vessel 11 which is a pressure accumulator, is connected to the circulating line 7 between the top ring main 4 and the first heat exchanger 8. The compensating vessel 11 equalizes the change of volume of water when this is heated.

The cooling tubes with the ring mains 4 and 5, the circulating line 7, the heat exchangers 8, 9 and 10 and the circulating pump 6 form a closed-cooling water circuit which comprises the primary circuit of a two-pressure system shown in FIG. 1. In the heat exchanger 8, the cooling water circuit is connected to a second circuit which comprises the secondary circuit of the two-pressure system. The secondary circuit includes a riser 12 and a downcomer 13. The riser 12 and the downcomer 13 connect the heating surfaces of the heat exchanger 8 to an exhaust steam drum 14. The riser 12 extends into the drum interior above the water level of the exhaust steam drum and the downcomer 13 enters the interior of the drum below the water level. The heat exchanger, therefore, is supplied with water from the exhaust steam drum by natural circulation (i.e., because of differences in specific gravity). The water begins to boil in the heat exchanger 8 at a pressure in this case of 25 bar, to be returned as a water-steam mixture through the riser 12 into the exhaust steam drum 14.

The exhaust steam drum 14 is part of the waste-heat boiler 15 connected to the output of the gasifier 2. The steam collected in the exhaust steam drum is supplied through a duct 16 to a superheater 17 situated in the waste-heat boiler 15 and then escapes. The cooling water is also supplied through a downcomer 18 to a cooling system situated downstream of the superheater 17 in the waste-heat boiler 15; and this cooling water flowing through the downcomer 18 is returned to the exhaust steam drum through a riser 19. The riser 19 and the downcomer 18 are both connected to the exhaust steam drum 14, the point of entry of the downcomer 18 being substantially lower than that of the riser 19.

The waste-heat boiler 15 is supplied with raw gas from the slag bath generator through conduit 15A after the gas has undergone intermediate cooling to a temperature about 850° C. to 900° C. The superheated steam discharged from the superheater 17 can be supplied for any desired purpose. The waste-heat boiler 15 is a medium pressure boiler given a steam drum pressure of 25 bar.

The heat exchanger 9 which follows the heat exchanger 8 on the cooling water system is intended for preheating the feed water for drum 14. It is connected in series with another feed-water preheater 20 in the waste-heat boiler, the feed water which is preheated in this manner being supplied to the exhaust steam drum through a duct 30. The heat exchanger 10 is optionally connected to a low-pressure boiler or comprises such a boiler. By controlling the cooling medium flowing through the heat exchanger 10, the temperature of the water entering the ring main 5 can be controlled to insure that the water, when it exits from the ring main 4, has a temperature below the boiling point of the water at the pressure utilized.

The construction of the cooling wall 1 is shown in the transverse section of FIG. 3. The individual tubes 37 extend vertically, as shown in FIG. 2, and are joined by vertical webs 38 which are welded to the tubes 37 to form a gas-tight wall. In accordance with the invention, each cooling tube 37 is coated on at least the inside or gas chamber side with a ceramic coating 36. The coatings 36 are applied by plasma or flame-spraying and preferably consist of alumina ($Al_2O_3$) with a thickness of from 0.2 to 3.0 millimeters, the relative thickness being exaggerated in the drawing for clarity of illustration. A covering 40 of ramming compound such as tamped clay is then applied over the entire inside surface of the wall 1. A curved retainer 39 for the compound 40 extends over each tube 37. The retainers 39 may be made of a metallic mesh material such as wire netting or expanded metal and extend vertically over the tubes. The retainers are supported on the wall 1 but are not directly connected to the tubes 37 and are preferably attached by spotwelding at the midpoints of the webs 38.

This construction effectively protects the cooling tubes both during start-up of the generator and during operation. Very high temperatures are reached in the generator and during start-up, the surface of the compound 40 has a temperature from 600° C. to 800° C., depending on its thickness. The melting point of the slag which is formed in the generator is usually between 900° C. and 1500° C., so that slag depositing on the compound 40 freezes thereon and increases the amount of thermal insulation between the cooling water and the source of heat. The surface temperature of this layer of slag, therefore, become high enough so that no more slag deposits and the slag flows freely to the slag bath at the bottom of the generator. During operation, the layer of slag cracks or spalls, due to thermal contraction or other causes, and since the compound 40 adheres to the slag it breaks up nd is pulled way from the tubes 37, or the coating 40 may be disintegrated or decomposed by diffusion of the slag into it. This action can result in exposing the bare water tubes with the danger mentioned above. The presence of the ceramic coating 36 of the present invention, however, obviates this problem since it provides some thermal insulation and because of its rough surface, the slag depositing on its adheres to the ceramic and solidifies to form a layer of slag which provides the desired thermal insulation. The radiation coefficient of the ceramic coating is much lower than that of the water tubes so that the ceramic coating will absorb only about a third of the radiation which the tubes would absorb, the remainder being reflected. This is advantageous before the protective slag layer or coating is produced and thereafter when the slag has become glassy, that is, transparent, and does not filter part of the thermal radiation.

We claim as our invention:

1. In a high-temperature gasifier, a slag bath generator including a plurality of cooling tubes extending vertically and joined together to form a gas-tight cylindrical wall, said tubes being connected in a closed-water circulating loop, the surfaces of the tubes on the inside of said wall being coated with a ceramic coating, and a ramming compound covering the inside of said wall and embedding said tubes and said ceramic coating thereon.

2. The combination defined in claim 1 in which said ceramic coating consists of alumina.

3. The combination defined in claim 2 in which the coating has a thickness of from 0.2 to 3.0 millimeters.

4. The combination defined in claim 1 in which said coating is applied by plasma spraying and has a roughened surface.

5. The combination defined in claim 1 and including retaining means for supporting said ramming compound, said retaining means being supported on said wall but not directly connected to the tubes.

6. The combination of claim 5 in which the retaining means consists of a metallic mesh.

7. The combination of claim 6 including vertical web members joining adjacent tubes, said retaining means extending over the tubes and being attached to the web members substantially at the midpoints thereof.

* * * * *